United States Patent [19]

Jump

[11] 4,446,587

[45] May 8, 1984

[54] PATIENT POSITIONING DEVICE

[76] Inventor: Clarence E. Jump, 1085 Tasman Dr. #208, Sunnyvale, Calif. 94086

[21] Appl. No.: 287,627

[22] Filed: Jul. 28, 1981

[51] Int. Cl.[3] ..... A47G 7/10

[52] U.S. Cl. ..... 5/83; 5/84; 5/89; 254/292; 414/921

[58] Field of Search ..... 5/81 R, 81 B, 83, 84, 5/85, 86, 87, 88, 89, 443; 414/921; 128/84 R, 84 B, 70; 254/290, 291, 292

[56] References Cited

U.S. PATENT DOCUMENTS

| | | | |
|---|---|---|---|
| 1,121,795 | 12/1914 | Burton | 128/84 R |
| 1,709,153 | 4/1929 | Pownall | 5/83 |
| 2,050,269 | 8/1936 | Brooks | 5/84 |
| 2,272,778 | 2/1942 | Reuter | 5/81 B |
| 2,494,591 | 1/1950 | Smith | 254/292 |
| 3,506,985 | 4/1970 | Lang | 5/81 R |
| 3,612,042 | 10/1971 | Fry | 5/81 B |
| 3,959,832 | 6/1976 | Parsons | 5/81 R |

FOREIGN PATENT DOCUMENTS

| | | | |
|---|---|---|---|
| 850516 | 10/1960 | United Kingdom | 5/88 |

*Primary Examiner*—Alexander Grosz
*Attorney, Agent, or Firm*—Paul L. Hickman

[57] ABSTRACT

A patient positioning device characterized by a horizontal support beam, a pair of motors coupled to the support beam, a first cable and hook assembly associated with a first motor, a second cable and hook assembly associated with a second motor, and a motor controller operative to selectively actuate the first motor, the second motor, or both motors simultaneously. Rigid, body contoured supports and/or flexible slings are coupled to one or both of the motors to selectively lift portions of a patient's body from a bed.

7 Claims, 9 Drawing Figures

PATIENT POSITIONING DEVICE

BACKGROUND OF THE INVENTION

1. Field of the Invention

This invention relates generally to medical equipment and more particulary to lifts or hoists for raising a patient from a hospital bed.

2. Description of the Prior Art

Bedridden patients and invalids pose special care and medical problems. For example, a patient who has lost the use of his or her limbs must often be fitted with adult sized diapers. The task of changing such a diaper on an adult is formidable in that the legs must be simultaneously spread and elevated during the entire diapering process.

Bed sores, which are brought on by prolonged contact with the bed surface, is another problem associated with bedridden patients and invalids. The simplest way to minimize the development of these painful sores is to periodically change the position of the patient or to remove the patient from contact with the bed. Again, this is a difficult task to perform with a full-sized adult.

A number of prior art devices can lift a patient from a hospital bed, but they do not suggest a solution to the above idenfitied problems. For example, Reuter in U.S. Pat. No. 2,272,778 describes an apparatus for lifting invalids that includes a frame which attaches to a bed, and a hammock assembly suspended from the frame by a winch assembly. Reuter's device is designed to lift patients in and out of bed, but cannot, for example, aid in positioning a patient for diapering. Other examples of devices for assisting a patient in and out of a bed be found in U.S. Pat. No. 1,385,424 of Billings, 33,545 of Ruth and 1,350,297 of Cooley.

Several prior art patents describe devices which can lift a part of a patient's body, such as a leg, from a bed. For example in U.S. Pat. No. 3,612,042 Fry discloses a hip exerciser including a rigid frame supported over a bed, and an elongated, rigid member pivotally suspended from the frame. A leg sling is attached to one end of the rigid member, and the other end of the member is pulled upon to raise and lower the leg and thus exercise the hip. Fry's invention is thus a specialized therapy device, and is not directed to the solution of the above identified problems.

Further problems much in evidence with prior art lifts include their lack of adjustability and their difficulty of setup.

SUMMARY OF THE INVENTION

An object of this invention is to provide a patient positioning device which elevates a portion of a patient's body to facilitate the changing of adult size diapers.

Another object of this invention is to provide a patient positioning device which can comfortably elevate a portion of a patient's body from a bed so as to reduce the severity of bedsores.

Yet another object of this invention is to provide such a device which can independently raise and lower the upper and lower portions of a patient's body.

A still further object of this invention is to provide a device which can position a patient at various inclinations, and then raise and lower the patient in that position.

Briefly, the invention includes a horizontal suspension beam supported over a patient's bed, a pair of motors spaced from each other and attached to the suspension beam, a pair of hook and cable members coupled one each to the motors, a controller for selectively actuating the motors, and at least one body support member coupled to at least one of the cable and hook assemblies. Various specialized body support members are disclosed including rigid, contoured members for supporting the lower body portions of a patient, and flexible slings for supporting upper body portions of a patient.

The suspension beam is preferably supported by a pair of uprights which engage opposing ends of the bed frame. One of the upright supports is adjustably coupled to the suspension beam so that the beam can be leveled no matter what the configuration of the bed frame may be. A lift bar may be attached between the hook and cable members and the body support members to even the load on the motors and to provide multiple anchoring points for the body support members.

An advantage of this invention is that, with the rigid, contoured body support members, the lower body portions of a patient can be elevated to facilite the changing of adult diapers and to alleviate the problems of bedsores.

Another advantage of this invention is that it is can accomodate many types of bed frames, that it is versatile in use due to its modularity and adjustable assembly, and that it can be easily installed and removed from the bed as a single unit.

A still further advantage of this invention is its two, independently controllable motors which allows the upper body position and lower body position of a patient to be adjusted independently or in concert.

A major advantage of this invention is that it can be operated by one attendant, which makes it ideal for use in convalescent and private homes where personnel is often limited.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
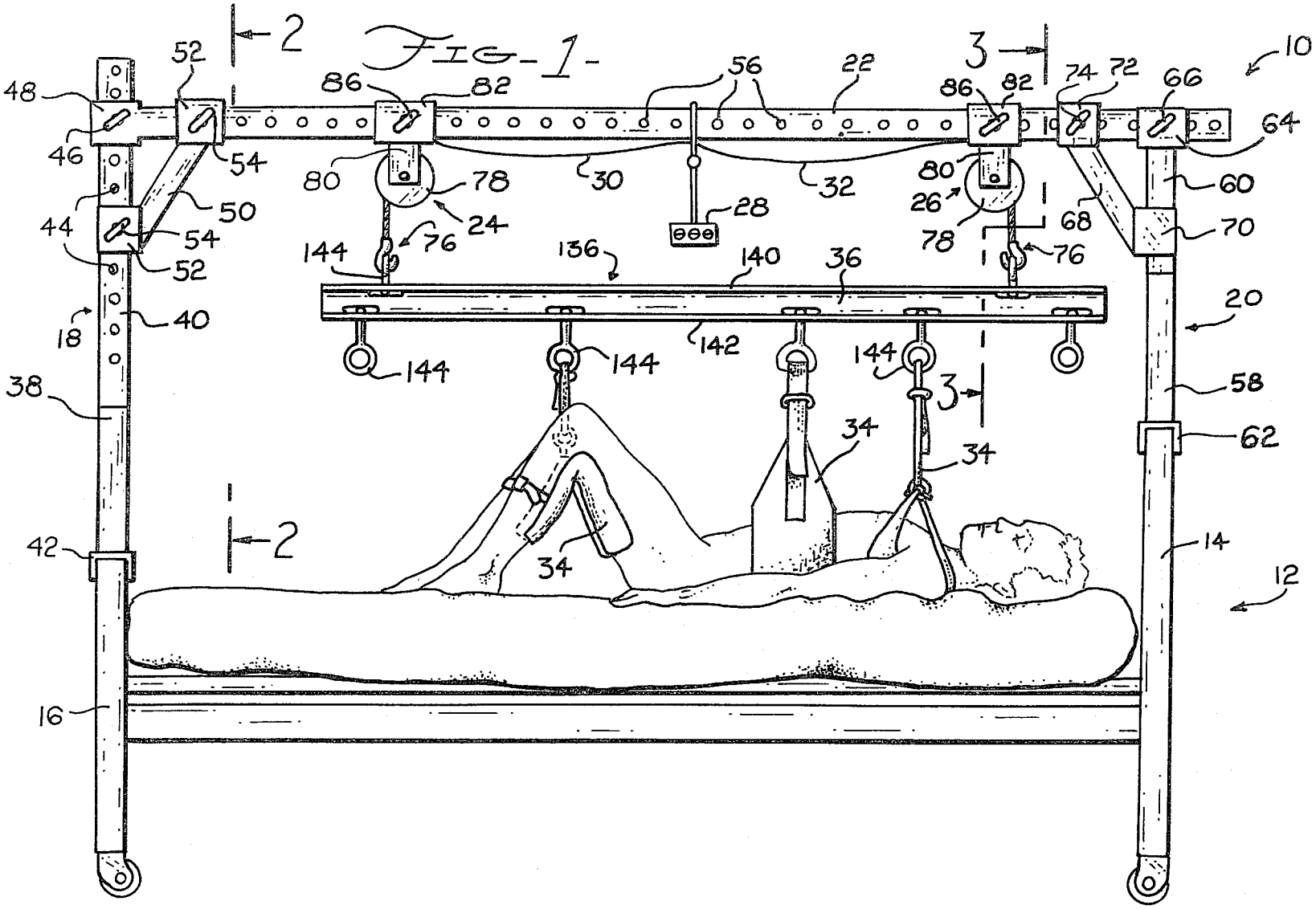
FIG. 1 is a side elevational view of a patient positioning device in accordance with the present invention.

Referring to FIG. 1 of the drawing, a patient positioning device 10 is shown in operational engagement with a hospital bed 12 having a headboard frame member 14 and a footboard frame member 16. The patient positioning device 10 includes a first upright support 18, a second upright support 20, a horizontal suspension beam 22 extending between the two supports, a pair of motorized hoists 24 and 26 coupled to the suspension beam, a control mechanism 28 electrically coupled to the hoists by wires 30 and 32, and a number of body supports 34 which may be attached directly to the hook and cable assemblies of the hoists or which may be coupled to the hoists by a lift bar 36.

Figure 2:
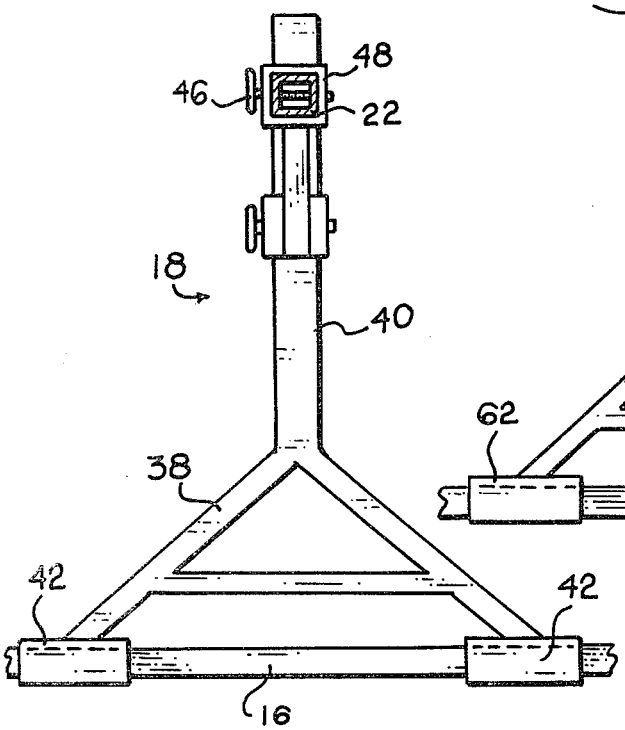
FIG. 2 is a cross-sectional view taken along line 2—2 of FIG. 1.

With additional reference to FIG. 2, support 18 can be seen to have a lower, A shaped portion 38, and an upper column portion 40 rising from the apex of portion 38. The lower extremities of the A shaped portion are provided with channel members 42 which engage portion 16 of the hospital bed's frame.

Upper column portion 40 is provided with a number of vertically spaced, threaded bores 44. The suspension beam 22 is adjustably attached to column 40 by a T shaped, threaded fastener 46 passing through a sleeve 48 of the suspension beam and engaging a pair of the threaded bores 44 of the column portion. A corner brace 50, likewise provided with sleeves 52 and T shaped threaded fasteners 54, adjustably engages bores 44 of the column portion and bores 56 provided along the length of the support beam.

Figure 3:
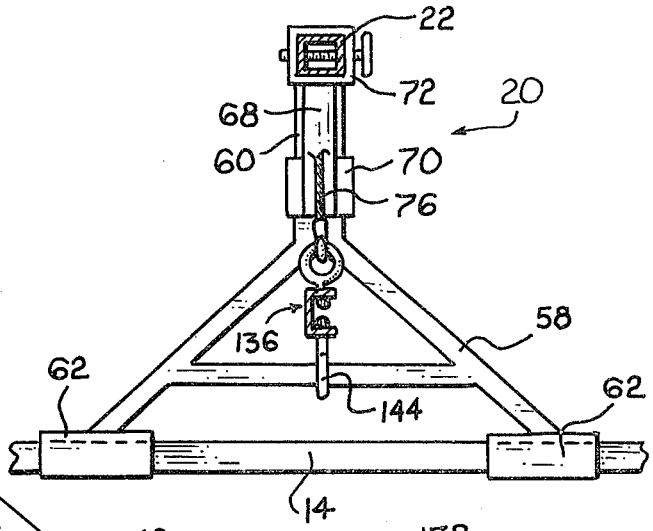
FIG. 3 is a cross-sectional view taken along line 3—3 of FIG. 1.

Referring now to FIGS. 1 and 3, it will be noted that support 20 also includes a lower, A shaped portion 58, and an upper column portion 60 rising from the apex of portion 58. Again, the lower extremities of the A shaped portion are provided with channel members 62 which engage portion 14 of the hospital bed's frame.

Attached to the top of column portion 60 is a sleeve 64 associated with a T shaped, threaded fastener 66 which adjustably engages one of bores 56 of the suspension beam. A brace 68 is attached to column 60 with a fixed sleeve 70 and is adjustably attached to beam 22 by a sliding sleeve 72 and associated T shaped fastenter 74.

Suspension beam 22 is preferably constructed from a strong, rigid material such as steel or aluminum. The hollow, square stock indicated in the figures is a preferred configuration for the beam because of its structural strength and light weight.

Figure 5:
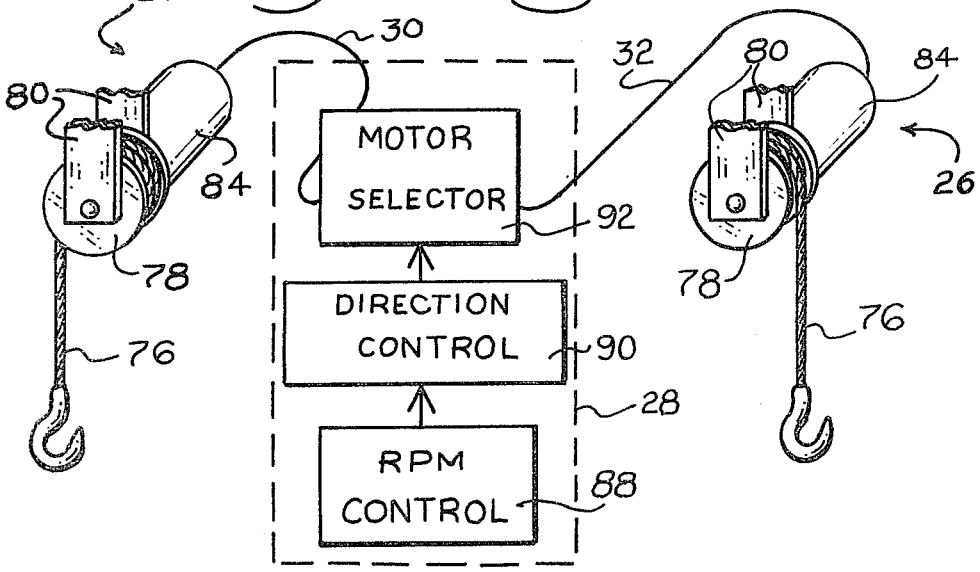
FIG. 5 is a partial perspective view and block diagram of the hoist assembly and associated control circuitry.

With reference to FIGS. 1 and 5, motorized hoists 24 and 26 each include a hook and cable assembly 76, a spool 78 around which the cable is wound, brackets 80 suspended from an adjustable sleeve 82, and a motor 84 having its casing attached to brackets 80 and having its shaft coupled to the spools 78. The spools 78 are rotatably coupled between the brackets 80, and the sleeves 82 are fixed in position by T shaped, threaded fasteners 86.

Control 28 is used to actuate, control, and coordinate the action of the two motors 84. The presently envisioned controller would include an RPM control 88 which would regulate the speed of the motors, a direction control 90 which would determine the direction of rotation of the motor's shaft, and a motor selector 92 which would power one motor, the other motor, both motors simultaneously, or neither of the motors. The controller is electrically coupled to the motors by wires 30 and 32.

Figure 6:
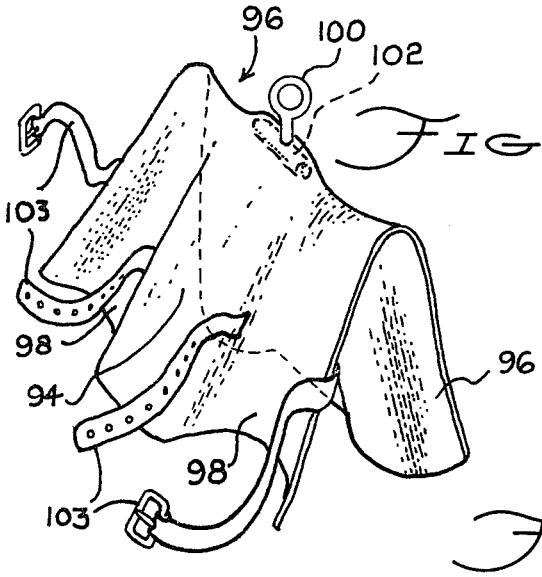
FIGS. 6 and 7 are perspective views of rigid, lower body supports of this invention.

The body supports are of two general types, namely rigid, body contoured supports for the lower body, and flexible slings for the upper body. In FIG. 6 a lower body support is shown to be an integral, molded, saddle shaped member 94 provided with a pair of thigh receptive recesses 96 on a first side and a diverging pair of calf receptive recess 98 on a second side. An eyebolt 100 is attached through the top of member 94 to a reinforcement bar 102. Straps 103 are provided to strap the calves of the patient to the support, if necessary. When placed under the legs of a patient, as shown in FIG. 1, member 94 elevates and spreads the legs of a patient to facilitate the replacement of adult sizes diapers.

Figure 7:
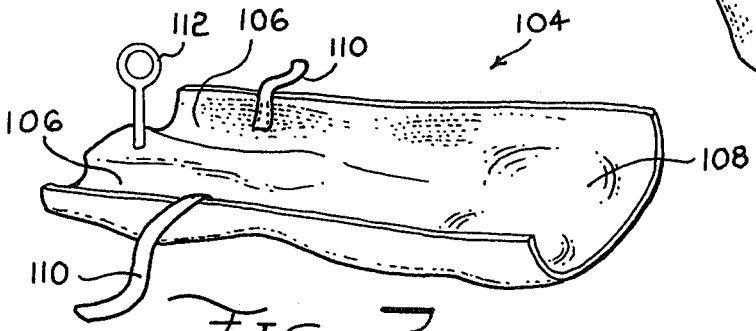

Another lower body support 104 is shown in FIG. 7 to be channel shaped and to have a contoured inner surface receptive to a patient's legs at 106 and a patient's buttocks at 108. A leg strap 110 is provided to secure the patient to the support, and an eyebolt 112 is provided for lifting the support. When placed under the lower body of the patient and elevated so that the patient's heels are just off the mattress of the bed, this type of support will help alleviate bedsore problems. Both supports 94 and 104 are preferably made from molded graphite epoxy, but plastics and other materials are also acceptable materials of construction.

Figure 8:
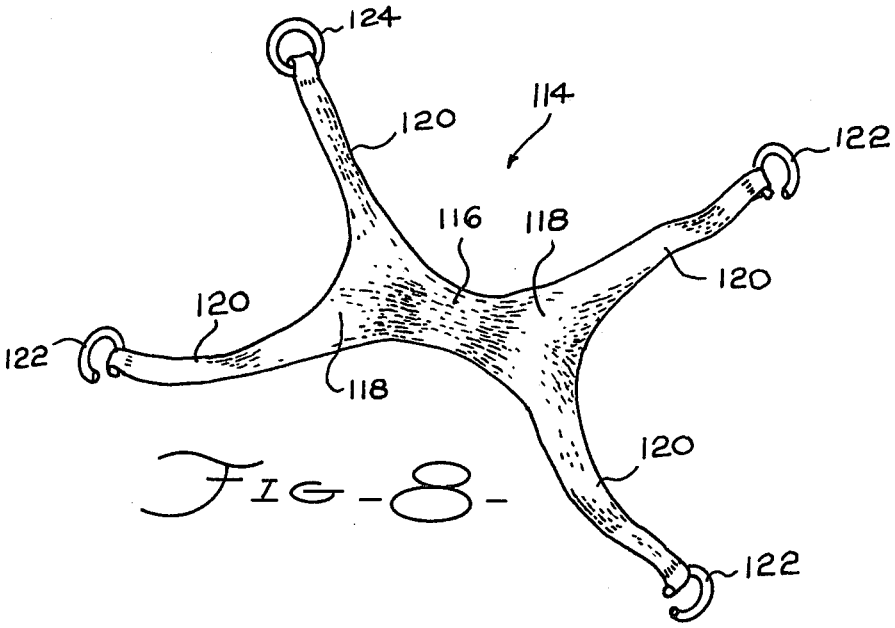

In FIG. 8 a flexible shoulder sling 114 is shown to include a portion 116 which supports the neck, portions 118 which support the shoulders, arms 120 extending from the portions 118, and hooks 122 and ring 124 attached to the end of the arms 120. As seen in FIG. 1, the neck and shoulder portions of the sling are placed under the patient, and hooks 122 engage ring 124.

Figure 9:
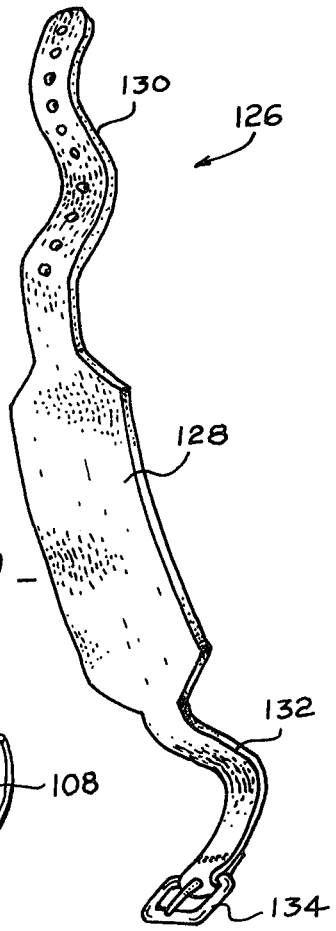
FIGS. 8 and 9 are perspective views of flexible, upper body supports of this invention.

A mid-body sling 126 is shown in FIG. 9 to include a widened portion 128, a strap portion 130 provided with a plurality of holes, and a strap portion 132 provided with a buckle 134. The sling is placed under the patient and then buckled into a loose loop around the patient's body.

A smaller version of the sling shown in FIG. 9 can be used to support the head of a patient. All of the upper body slings are preferably made from a soft, strong, and flexible material, such as soft leather or reinforced cloth.

Figure 4:
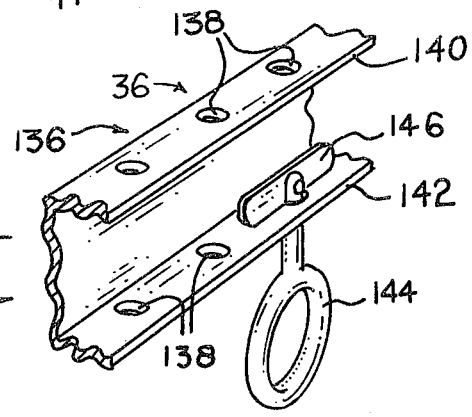
FIG. 4 is a partially broken perspective view of the lift bar 36 of FIGS. 1 and 3.

The body supports can be connected directly to the hook and cable assemblies of the hoists, or they can be connected to a lift bar 136 as shown in FIGS. 1, 3, and 4. The lift bar is an elongated, channel shaped member provided with a plurality of holes 138 through its two flanges 140 and 142. A number of eyebolts 144 having pivotable ends 146 can attach to the bar by insertion through the flange holes. Hook and cable assemblies 76 engage eyebolts 144 engaged with upper flange 140, and the body supports 34 are coupled to eyebolts engaging the holes in lower flange 142. The lift bar equalizes the load on the two motors, allows more than two body supports to be used at a time, and allows a patient to be raised and lowered at a predetermined angle of inclination.

To set up the present device for use, channel members 42 and 62 of the supports are engaged with portions 16 and 14, respectively, of the bed frame. The suspension beam 22 is adjustably coupled to the supports so that the assembled unit is correctly sized for the bed frame. For example, if the bed frame is longer than normal the attachment of beam 22 to sleeves 64 and 72 can be adjusted, and if the beam 22 needs to be leveled the attachment of sleeves 48 and 52 can be adjusted. Thus, the present device can fit a range of bed frame types.

Once assembled it is apparent that the entire unit can be quickly engaged and disengaged with the bed frame, since channel members 42 and 62 engage but are not affixed to the bed frame. Should the need arise, it would not be difficult for two persons, or even one person, to remove the unit from or place the unit on the bed frame.

Once assembled, the desired use of the device determines the placement of the hoist assemblies, lift bar, and body supports. For example, if the patient's adult diapers needs to be changed rigid body support 94 can be coupled directly to hook and cable 76 without the intermediary of lift bar 36. The hoist assembly position can be adjusted along the length of the support beam to facilitate the operation. The RPM controller 88 is then adjusted for a suitable rate of lift speed, the direction controller 90 is adjusted to cause the hook and cable wrap around the spool, and the motor selector 92 actuates the appropriate motor. After the diaper is changed the direction control is reversed and the patient is lowered to the bed.

It will be noted that the remaining hoist can also be used to lift the upper body of a patient without need for the lift bar. The motor selector could selectively actuate one motor and then the other to position the patient in a number of positions.

When the lift bar is used a patient can be raised and lowered in any desired position. After appropriate body supports are attached to the patient, the angle of the lift bar can be adjusted by actuating one and then the other of the hoist assemblies. Once the patient is positioned as desired, the lift bar can be raised and lowered in that position by actuating both motors simultaneously.

While this invention has been described in terms of a few preferred embodiments, it is contemplated that persons reading the preceding descriptions and studying the drawing will realize various alterations, permutations and modifications thereof. For example, instead of attaching to the bed frame, the present invention could comprise a wheeled dolly which could straddle a hospital bed.

It is therefore intended that the following appended claims be interpreted as including all such alterations, permutations and modifications as fall within the true spirit and scope of the present invention.

What is claimed is:

1. A patient positioning device comprising:

(a) an elongated, substantially horizontal, suspension means including a first, upright support means, a second upright support means, an elongated, substantially horizontal suspension beam, a vertical adjustment means coupling a first end of said suspension beam to said first support means, and horizontal adjustment means for attaching said second end of said suspension beam to said second support means;

(b) a first vertical lift means coupled to said suspension means, and a second vertical lift means coupled to said suspension means;

(c) motor means coupled to said first vertical lift means and to said second vertical lift means;

(d) a motor controller means coupled to said motor means and operative to independently control said first vertical lift means and said second vertical lift means; and (e) a body portion support means coupled to at least one of said first vertical lift means and said second vertical lift means, whereby a portion of a patient's body may be selectively raised under the control of said motor control means, said body portion support means including a rigid, contoured, saddle shaped member having a pair of thigh receptive recesses on a first side, and a diverging pair of calf receptive recesses on a second side, whereby a patient's legs can be lifted in a bent-kneed, spread legged position.

2. A patient positioning device as recited in claim 1 further comprising an elongated lift bar attached proximate a first end portion to said first lift means and attached proximate a second end portion to said second lift means, said body portion support means being attached to a midlength portion of said lift bar.

3. A patient positioning device as recited in claim 2 wherein said first upright support means has a lower portion adapted to engage the foot-board of a bed, and wherein said second upright support means has a lower portion adapted to engage the head-board of said bed.

4. A patient positioning device as recited in claim 3 wherein said first upright support means and said second upright support means each include a lower, A shaped portion, a pair of channel portions attached to the lower extremities of the A shaped portion and adapted to engage said foot-board and said head-board, respectively, and an upright column attached at a lower end to the apex of said A shaped portion and coupled at an upper end to said support beam.

5. A patient positioning device as recited in claim 1 wherein said body support means further comprises a second rigid member that is channel shaped and provided with a pair of lower leg receptive recesses, whereby a patient's heels can be selectively lifted.

6. In a patient positioning device including suspension means provided over a patient's bed, at least one lift means attached to said suspension means, and a body portion support means coupled to said lift means, an improved body portion support means comprising:

a rigid, contoured, saddle shaped member having a pair of thigh receptive recesses on a first side, and a pair of calf receptive recesses on a second side, whereby a patient's legs can be lifted in a bent-kneed, position.

7. A patient positioning device for use with a hospital bed comprising:

(a) a first upright support means including a first A-shaped frame having downwardly extending channel members adapted to engage a first upper surface portion of said hospital bed and a first column rising from said first A-shaped frame;

(b) a second upright support means including a second A-shaped frame having downwardly extending channel members adapted to engage a second upper surface portion of said hospital bed and a second column rising from said second A-shaped frame;

(c) a substantially horizontal suspension beam;

(d) horizontal adjustment means for attaching a first end of said suspension beam to said first column;

(e) vertical adjustment means for attaching a second end of said suspension beam to said second column;

(f) vertical lift means coupled to said horizontal suspension beam including two, independently actuable lifts, and a free-hanging lift bar supported by said two lifts; and (g) a body portion support means coupled to said vertical lift means, whereby a portion of a patient's body may be selectively raised.

* * * * *